United States Patent [19]

Wilson

[11] 4,286,637

[45] Sep. 1, 1981

[54] APPARATUS FOR DISPENSING LIQUIDS INTO TUBES

[75] Inventor: Strathearn Wilson, King City, Canada

[73] Assignee: Connaught Laboratories Limited, Willowdale, Canada

[21] Appl. No.: 174,203

[22] Filed: Jul. 31, 1980

Related U.S. Application Data

[63] Continuation-in-part of Ser. No. 959,008, Nov. 9, 1978, abandoned.

[51] Int. Cl.[3] ..... B65B 3/04

[52] U.S. Cl. ..... 141/374; 73/864.24; 422/57; 422/100; 422/102

[58] Field of Search ..... 141/374, 392, 165, 166, 141/312, 311 R; 422/100, 99, 102, 104, 57, 71; 220/255, 21, 410; 73/425.4 P

[56] References Cited

U.S. PATENT DOCUMENTS

| | | | |
|---|---|---|---|
| 2,771,913 | 11/1956 | Flashnöcker | 141/374 X |
| 3,494,201 | 2/1970 | Roach | 73/425.4 P |
| 3,734,336 | 5/1973 | Rankow et al. | 200/400 X |
| 3,785,928 | 1/1974 | Kessler | 422/102 |
| 3,955,704 | 5/1976 | Smith et al. | 220/21 X |

FOREIGN PATENT DOCUMENTS

| | | | |
|---|---|---|---|
| 1490704 | 6/1967 | France | 73/425.4 P |

*Primary Examiner*—William D. Martin, Jr.
*Attorney, Agent, or Firm*—Sim & McBurney

[57] ABSTRACT

An apparatus useful in the addition of reagents in small quantities to micro reaction systems is described. The apparatus enables liquids to be dispensed within a narrow desired area of a receiving tube or other receptacle from a needle while avoiding undesired contact with tube walls. Guide means control the position of the needle with respect to the tube. The apparatus is particularly useful in connection with a radioimmune assay system wherein radioactive labelled protein is delivered to a tube.

8 Claims, 2 Drawing Figures

APPARATUS FOR DISPENSING LIQUIDS INTO TUBES

REFERENCE TO RELATED APPLICATION

This application is a continuation-in-part of copending U.S. patent application Ser. No. 959,008 filed Nov. 9, 1978, now abandoned.

FIELD OF THE INVENTION

The present invention relates to a device that is to be used generally for directing the addition of liquids to a reaction system, such that the liquid delivered is confined to a desired small area of the reaction vessel's surface. The invention is particularly useful in a radioimmune assay system wherein radioactive labelled protein is delivered to a tube.

BACKGROUND TO THE INVENTION

In the addition of reagents in small quantities to micro reaction systems, it is important that all the reagent be delivered and that none be left on the sides of the reaction vessel. This is especially true when the added reagent is part of an eventual detection system for studying the reaction. For example, in the addition of radioactive labelled materials to a reaction vessel, where the final measurement is the amount of radioactivity remaining in the vessel, perhaps in the form of a precipitate or complex bound to the surface of the vessel, it is highly desirable that no labelled material be splashed or otherwise be deposited onto the sides of the vessel, which would lead to a higher than expected count. This is especially true if the vessel is placed directly into the counting apparatus as in the case of a tube.

This problem has direct relevance to radioimmune assays conducted in small tubes, where volumes are small and accurate counts are required. The basic premise behind any radioimmune assay is that an antigen or antibody, is allowed to combine with its respective radioactively-labelled antibody or antigen, as the case may be, and that the resultant labelled complex is isolated, the radioactivity measured and, from this figure and comparison with measurements taken on standard materials, the amount of original material calculated.

One particular type of assay that employs an extension of this concept is the so-called "sandwich" assay employing protein-coated tubes. In this assay, an antibody to the desired antigen is first absorbed from solution onto the inner surface of a glass or plastic tube. The remainder of the solution is removed and the tube washed. Both glass and plastic will readily absorb proteins onto their surfaces and after the washing a "coat" of antibody is left on the tube. The samples to be tested are then placed in the tubes and any antigen present in the sample will be complexed by the antibody on the tube. After removal of the sample and washing, the tubes are treated with radioactively-labelled antibody and it will be readily seen that where antigen is present, labelled antibody will be complex in a "sandwich" onto the tube. After washing, the tube is placed directly in a counter and the number of counts in excess of a known negative standard will give an estimate of the quantity of antigen present in the original sample.

Because of the aforementioned adsorptive properties of the tube material, any radioactive protein that is splashed or otherwise placed on the sides of the tube rather than contacting the already-coated portion of the tube may absorb to the inside of the tube or dry onto the wall of the tube. This labelled protein will not readily be washed off and will tend to leave labelled protein on the tube where it has not reacted with the antigen, resulting in a higher count than expected. Such higher counts will be especially detrimental in samples in which there is no antigen and which might normally be expected to give low counts. When this occurs, the result is a false positive reaction.

Whilst it is relatively easy to ensure that no splashing occurs on the addition of reagents, the actual reagent addition requires dexterity and is time-consuming and tedious. Because radioimmune assays are becoming very useful for diagnostic purposes and many hundreds of tests have to be performed in a day, it is desirable that false positives be reduced to a minimum and yet the maximum number of tests be performed.

SUMMARY OF INVENTION

The present invention provides an apparatus that allows for the quick dispensing of solutions into small tubes or other narrowly defined areas without the possible concomitant splashing, permitting the provision of a radioimmune assay kit which is capable of conducting many tests rapidly without error.

DESCRIPTION OF PREFERRED EMBODIMENT

Figure 2:
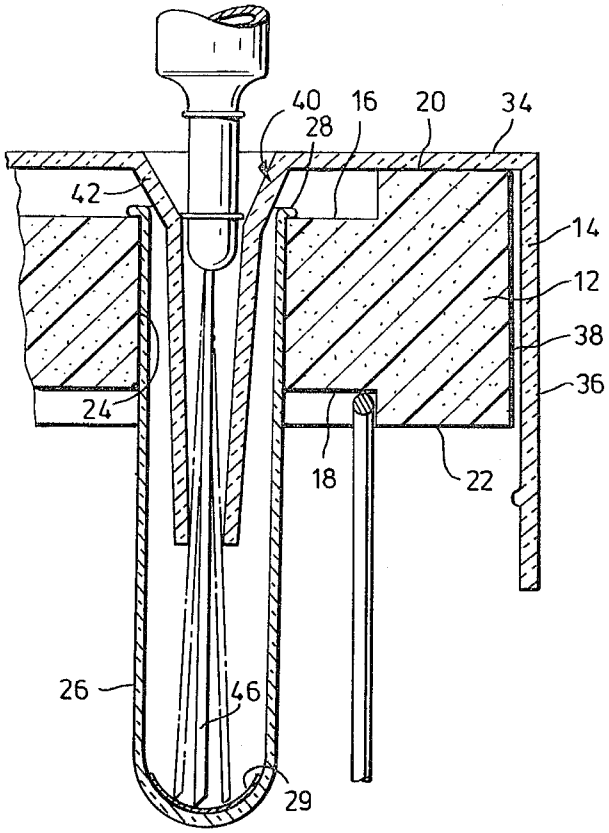
FIG. 2 is a section taken on line 2—2 of FIG. 1.
Figure 1:
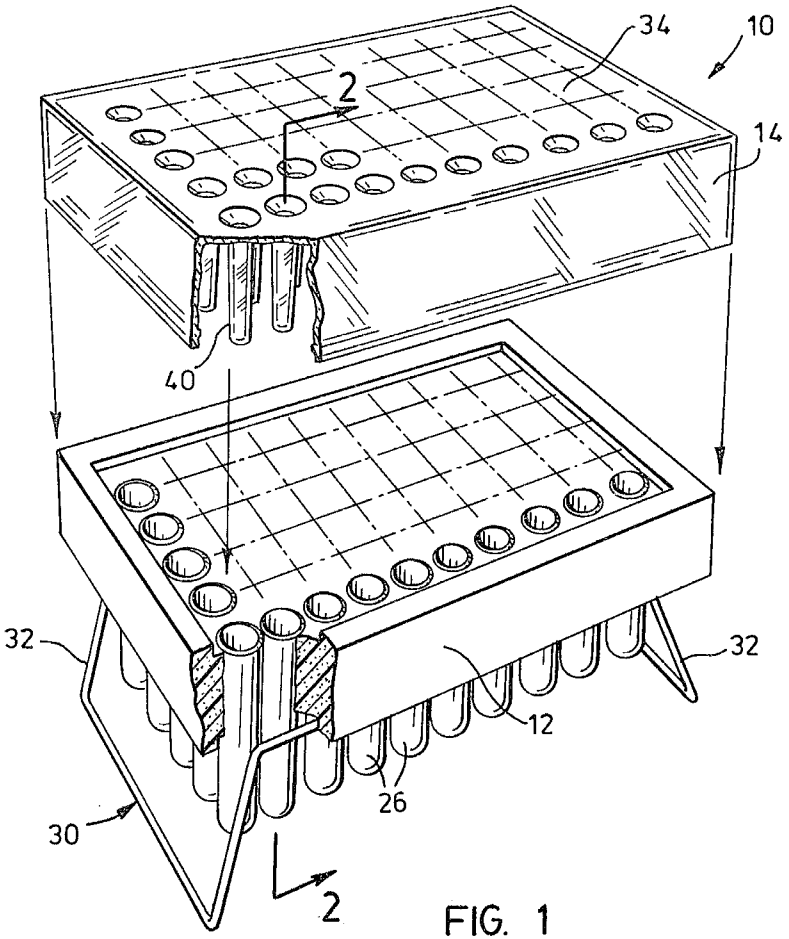
FIG. 1 is a perspective exploded view with parts cut away for illustrative purposes, of a radioimmune assay kit embodying the guide device of this invention.

Referring to the drawings, a radioimmune assay kit 10 comprises a lower block of foamed plastic material 12 such as, expanded polystyrene or other convenient shock and thermal-resistant support material, and an upper cover member 14, preferably formed of rigid clear plastic material or other convenient material of construction. The lower block 12 has recesses 16 and 18 in the upper and lower surfaces 20 and 22 respectively. A plurality of holes 24 extend through the block 12 between the recesses 16 and 18 and are arranged in a regular pattern. Extending through each of the holes 24 and positioned in snug fit relationship therewith is an open-topped reaction tube 26 with the lip 28 thereof engaging the surface of the recess 16 of the block 12, as can be seen in FIG. 2. The tubes 26 are adapted to receive the reagents discussed above and may be formed of glass or convenient polymeric material, such as, polystyrene. Where the tubes 26 are to be used for an assay of the sandwich type an antibody protein layer 29 is first coated on the tube inner surface.

A wire frame 30 is received in the lower recess 18 and includes depending leg portions 32 for supporting the block 12 on a surface.

The cover member 14 comprises a flat plate portion 34 which engages the top surface 20 of the block 12 in face-abutting relationship and integral depending outer walls 36 which extend adjacent the side walls 38 of the lower block 12.

Depending from the flat plate portion 34 are a plurality of integrally-formed downwardly-tapering tubular members 40 or guide means, open at both ends and in number the same as the number of tubes 26. Each of the tubular guide members 26 extends generally axially and centrally of one of the tubes 26.

It will be seen from FIG. 2 that, owing to the recessed location of the tubes 26, no part of the guide means 40 touches the tube 26 so that any contamination from this source is avoided.

The tubular members 40 are dimensioned to extend to a position upwardly spaced with respect to the lower extremities of the depending walls 36.

As may be seen from FIG. 2, each of the tubular members 40 comprises a short upper steeply-tapering conical portion 42 adjacent the plate portion 22 and a long gently-tapering portion 44 extending from the steeply-tapering portion 44 to the lower end of the tubular member 40.

The conical portion 42 is intended to aid in location of the delivery system, for example, a syringe needle 46 or a micropipette, into the tubular member 40, and acts as a support system for the delivery system when positioned in the tubular member 40 such that the needle 46 does not extend to the base of the tube 26. The angle of the walls of the conical portion 42 may vary to suit any delivery system relative to different sizes of tubes, preferably between about 30° and about 60°, more preferably about 45°.

The gently-tapering portion 44 is dimensioned to act as a guide for the needle 46 or other delivery system to ensure that the needle 46 does not engage the walls of the tube 26 even if inserted or withdrawn non-axially with respect to the tube 26. This may be seen by the dotted outlines of the needle 46 which represent the limits of movement of the needle 46.

While the combined effect of the shaping of the tubular members 40 is to ensure that the needle 46 does not quite reach the bottom of the tube 26 or touch the sides of the tube 26, even though it is moved or non-axially inserted, it is preferred to dimension and shape the tubular members 40 so that, after delivery of the reagent to the tube 26 from the needle 46, the tip of the needle 46 just touches the liquid surface. The latter construction is particularly useful in avoiding contamination, since the tip of the needle 46 drains evenly. If a drop of liquid is left on the tip of the needle 46, it may be knocked off during removal of the needle 46.

The assay kit 10 may be used in any convenient radioimmune assay, for example, for the detection of Hepatitis B surface antigen. The provision of the guides permits rapid insertion and removal of delivery systems for dispensing liquids and avoids the time-consuming prior operations necessary to ensure proper dispensing of liquid samples into the tube and the incidence of incorrect readings owing to improper dispensing.

SUMMARY OF DISCLOSURE

In summary of this disclosure, the present invention provides a novel radioimmune assay kit which can effect a number of assays rapidly with a minimum of incorrect readings. While the present invention has been described particularly with reference to a radioimmune assay kit, it will be apparent that the guide means has wider applicability to all systems wherein the dispensing of liquids into tubes or other restricted locations is required to be effected in precisely controlled manner. Modifications are possible within the scope of the invention.

What I claim is:

1. In combination, an elongate dispensing member for dispensing liquids;

a guide apparatus for use in conjunction with said elongate dispensing member in connection with the dispensing of liquids therefrom, liquid receiving means of confined dimension located below said guide apparatus for receiving said dispensed liquids;

said guide apparatus comprising:

a planar plate-like member having longitudinal and lateral extremities and positioned substantially horizontally in use, planar wall members depending from each of said longitudinal and lateral extremities and terminating in a plane parallel to and downwardly spaced from said plate-like member, a plurality of guide means integrally formed with said plate-like member and comprising tubular members extending in tapering fashion from one open end at said plate-like member towards said plane and terminating in another open end at a location upwardly spaced from said plane and from said liquid receiving means, each of said tubular guide means being in substantial alignment with one of said liquid-receiving means and being dimensioned to permit said elongate dispensing member to be supported thereby and to extend through said another open end to permit liquid to be dispensed from said dispensing member to said liquid receiving means.

2. The apparatus of claim 1, wherein said guide means comprises a plurality of regularly-spaced parallel tapering tubular members.

3. The apparatus of claim 2, wherein each of said tubular members comprises an upper steeply-tapering conical portion adjacent said plate-like member and a lower gently-tapering portion for the remainder of the length thereof.

4. An apparatus for the dispensing of liquids into tubes from an elongate dispensing member, comprising a block of support material having an upper surface and side surfaces and a plurality of upwardly-opening holes formed therein, a plurality of tubes located in snug fit relationship one in each of said holes in recessed manner with respect to said upper surface, and a cover member for said block of support material, said cover member comprising a planar plate-like portion extending in face-abutting relationship with said upper surface of said block and planar wall portion depending from longitudinal and lateral extremities of said plate-like portions and extending adjacent said side surfaces of said block, said cover member further comprising a plurality of open ended guide means extending in tapering fashion from said plate-like portion one into each of said plurality of tubes in non-touching axial relationship therewith, each said guide means being dimensioned to position and support said elongate dispensing member in said tube spaced from the walls and bottom thereof in all positions of said elongate dispensing member with respect to said guide means.

5. The apparatus of claim 4, wherein guide means comprises a tubular member having a short steeply-tapered conical portion adjacent said plate-like portion and a long gently-tapered portion for the remainder of the length thereof.

6. The apparatus of claim 5 wherein said steeply-shaped conical portion slopes at an angle of about 30° to about 60° to the axis of said tubular member.

7. The apparatus of claim 4 wherein said holes extend through said block of support material and including support means for spacing said block spaced from a support surface whereby said tubes extending throug said block are spaced from said support surface.

8. The apparatus of claim 4 wherein said upper sur face is defined by a peripheral region thereof raise above a recessed region.

* * * * *